United States Patent [19]

Watanabe et al.

[11] Patent Number: 4,764,456

[45] Date of Patent: Aug. 16, 1988

[54] SILVER HALIDE COLOR PHOTOGRAPHIC MATERIAL

[75] Inventors: Toshiyuki Watanabe; Naoyasu Deguchi, both of Kanagawa, Japan

[73] Assignee: Fuji Photo Film Co., Ltd., Kanagawa, Japan

[21] Appl. No.: 901,224

[22] Filed: Aug. 28, 1986

[30] Foreign Application Priority Data

Aug. 28, 1985 [JP] Japan ..... 60-189291

[51] Int. Cl.[4] ..... G03C 7/26; G03C 7/38

[52] U.S. Cl. ..... 430/550; 430/548; 430/558; 430/581; 430/585; 430/588

[58] Field of Search ..... 430/550, 585, 588, 581, 430/558

[56] References Cited

U.S. PATENT DOCUMENTS

| | | | |
|---|---|---|---|
| 3,672,898 | 6/1972 | Schwan et al. | 430/505 |
| 4,040,841 | 8/1977 | Hinata et al. | 430/550 |
| 4,559,297 | 12/1985 | Seto et al. | 430/558 |
| 4,607,005 | 8/1986 | Urata | 430/550 |

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A silver halide color photographic material is described, comprising at least one red-sensitive silver halide emulsion layer, at least one green-sensitive silver halide emulsion layer and at least one blue-sensitive silver halide emulsion layer on a support, wherein at least one coupler represented by general formula (I) is contained in at least the green-sensitive emulsion layer:

(I)

Moieties in the couplers are defined in the specification. The wavelength of the red-sensitive emulsion layer shows a defined maximum spectral sensitivity in the short wavelength side and wavelengths corresponding to 80%, 50%, 40%, 20% and 10% of the maximum sensitivity in defined wavelength regions. Similar values are given for the long wavelength side of spectral sensitivity.

13 Claims, 1 Drawing Sheet

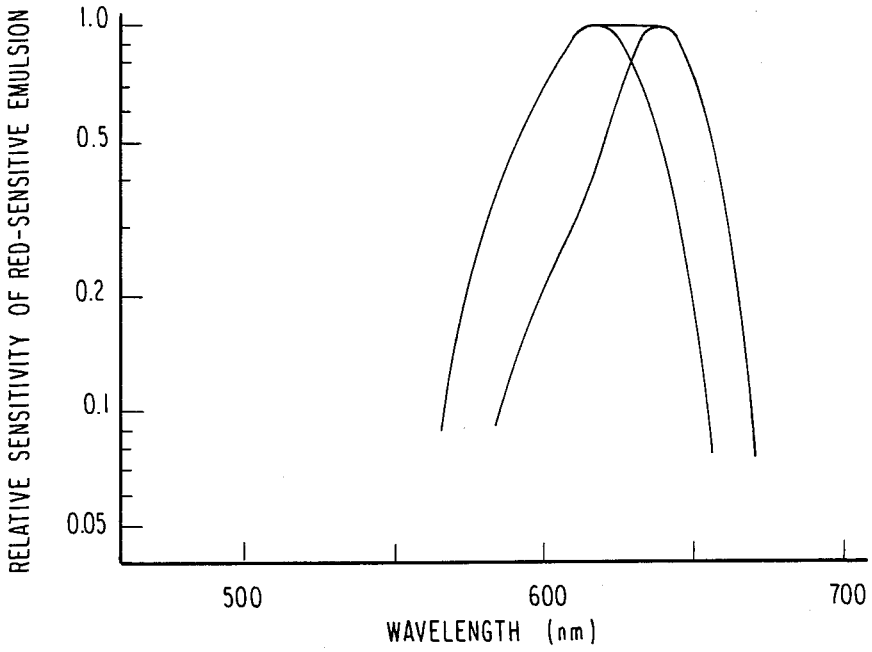
RELATIVE SENSITIVITY OF RED-SENSITIVE EMULSION
1.0
0.5
0.2
0.1
0.05
500
600
700
WAVELENGTH (nm)

SILVER HALIDE COLOR PHOTOGRAPHIC MATERIAL

FIELD OF THE INVENTION

The present invention relates to a silver halide color photographic material. More particularly, the present invention relates to a silver halide color reversal photographic material having an improved color reproducibility.

BACKGROUND OF THE INVENTION

A silver halide color photographic material (hereinafter referred to as "light-sensitive material") has a multilayered light-sensitive structure consisting of three silver halide emulsion layers each selectively sensitized to be sensitive to blue light, green light and red light. These layers are coated on a support. In conventional negative and color reversal films, a blue-sensitive emulsion layer, a green-sensitive emulsion layer and a red-sensitive emulsion layer are arranged in a multilayer construction in this order from the surface to be exposed to light. Furthermore, a bleachable yellow filter layer or antihalation layer, an intermediate layer, or a protective layer may be added to the above construction depending on the application.

Known processes for the formation of color photographic images are divided broadly into two categories, i.e., an additive process and a subtractive process. In the latter type of process, photographic couplers forming three colors, i.e., yellow, magenta and cyan, are incorporated in the light-sensitive layers. The light-sensitive material which has been imagewise exposed to light undergoes color development by a color developing agent.

In color development, an aromatic primary amine contained in the color developing agent and a photographic coupler present in the light-sensitive material undergo an oxidation coupling reaction. As a result, an indophenol or an azomethine color forming dye is produced. In order to provide a color photographic image having an excellent color reproducibility, it is essential that the color forming dyes thus produced be fresh cyan, magenta and yellow dyes having less side absorption.

The above-mentioned cyan dyes have an unnecessary absorption of magenta and yellow components, and the magenta dyes have an unnecessary absorption of yellow and cyan components. This disadvantage has resulted in a lesser ability to reproduce colors of a subject having a high chroma. In order to improve color reproducibility, efforts have been made to reduce such an unnecessary absorption. Further, in order to eliminate this problem of poor color reproducibility due to unnecessary absorption, attempts have been made to improve interlayer and multilayer effects upon development. However, these approaches have failed to solve the problems related to poor color reproducibility.

On the other hand, it is known that color reproducibility can be greatly affected by spectral sensitivity. Moreover, it is difficult to precisely reproduce purple without deteriorating the red chroma. Therefore, various efforts have been made to eliminate this problem. For example, if the wavelength of the maximum spectral sensitivity of the red-sensitive emulsion layer is set at a relatively long wavelength range, e.g., 650 to 660 nm, in order to prevent deterioration of red chroma, purple is reproduced to a reddish purple-based color short of cyan.

On the contrary, if the spectral sensitivity of the red-sensitive emulsion layer is set at a slightly shorter wavelength range, purple is more precisely reproduced, but the sensitivity of the red-sensitive emulsion layer to red light becomes insufficient. Red is thus reproduced to a color with a tincture of cyan, resulting in lower chroma.

An example of an approach to improve the color reproducibility of a color photographic light-sensitive material is disclosed in U.S. Pat. No. 3,672,898. In this approach, changes in color reproducibility are reduced when photographing is conducted under various light sources having different color temperatures. However, if the spectral sensitivity specified in this patent is used, the spectral sensitivity of the red-sensitive emulsion layer is set at too short a wavelength range. As a result, the sensitivity of the red-sensitive emulsion layer to red light is poor. Therefore, red is reproduced to a color with an extremely high tincture of cyan, resulting in lower chroma. Further, purple is reproduced to a color with a tincture of cyan.

Therefore, it has been desired to improve the purple reproducibility of a photographic light-sensitive material without causing any deterioration of the chroma, especially of red.

SUMMARY OF THE INVENTION

It is, therefore, an object of the present invention to provide a silver halide color photographic material having an improved color reproducibility.

It is another object of the present invention to improve the precision of color reproduction of a silver halide color photographic material and the chroma of colors thus reproduced.

It is a further object of the present invention to accomplish precise high saturation reproduction of red and purple colors by a silver halide color reversal photographic material.

These and other objects of the present invention will become more apparent from the following detailed description of the invention and examples thereof.

These objects of the present invention are accomplished by a silver halide color photographic material comprising at least one red-sensitive silver halide emulsion layer, one green-sensitive silver halide emulsion layer and one blue-sensitive silver halide emulsion layer on a support, wherein at least one coupler represented by general formula (I) shown below is contained in at least the green-sensitive emulsion layer, and the wavelength at which the red-sensitive emulsion layer shows the maximum spectral sensitivity is in the range of about 620 to about 640 nm. Further, regarding the short wavelength side of spectral sensitivity as to the red-sensitive emulsion layer, the wavelength corresponding to 80% of the maximum sensitivity is in the range of about 605 to about 630 nm, the wavelength corresponding to 50% of the maximum sensitivity is in the range of about 591 to about 622 nm, the wavelength corresponding to 40% of the maximum sensitivity is in the range of about 586 to about 618 nm, the wavelength corresponding to 20% of the maximum sensitivity is in the range of about 575 to about 600 nm, and the wavelength corresponding to 10% of the maximum sensitivity is in the range of about 567 to about 586 nm. With respect to the long wavelength side of spectral sensitivity as to the red-sensitive emulsion layer, the wavelength corresponding to 80% of the maximum sensitivity is in the range of about 631 to about 651 nm, the wavelength corresponding to 50% of the maximum sensitivity is in the range of about 640 to about 658 nm, the wavelength corresponding to 40% of the maximum sensitivity is in the range of about 643 to about 660 nm, the wavelength corresponding to 20% of the maximum sensitivity is in the range of about 650 to 666 nm, and the wavelength corresponding to 10% of the maximum sensitivity is in the range of about 655 to about 670 nm. The abovementioned coupler represented by general formula (I) is described herein as follows.

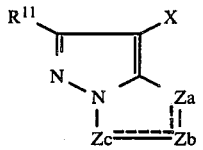

(I)

wherein $R^{11}$ represents a hydrogen atom or a substituent; X represents a hydrogen atom or a group releasable upon coupling with an oxidation product of an aromatic primary amine developing agent; Za, Zb and Zc each represents a methine group, a substituted methine group, =N— or —NH—; either one of the Za—Zb bond or the Zb—Zc bond is a double bond with the other being a single bond; when the Zb—Zc bond is a carbon-carbon double bond, it may form an aromatic ring; when any one of $R^{11}$, X and the substituted methine group as represented by Za, Zb or Zc is a divalent or polyvalent group, it may form a dimer or a polymer.

BRIEF DESCRIPTION OF THE DRAWING

The FIGURE shows a graph illustrating the spectral sensitivity of a light-sensitive material of the present invention. This graph shows a logarithm of the relative sensitivity of a red-sensitive emulsion layer versus wavelength (nm).

DETAILED DESCRIPTION OF THE INVENTION

Referring to general formula (I), the term "a dimer or a polymer" means the cases in which two or more moieties having general formula (I) occur in 1 molecule and, thus, includes the bis compound and polymeric couplers. The polymeric couplers may be a homopolymer of monomer units having the moiety represented by general formula (I) (preferably monomers containing vinyl groups, hereinafter referred to a "vinyl monomers") or a copolymer containing non-coloring ethylenic monomer units which do not undergo a coupling reaction with an oxidation product of aromatic primary amine developing agents.

Among the pyrazoloazole couplers represented by general formula (I) above, preferred couplers are those as represented by the following general formula (II), (III), (IV), (V), (VI), (VII) and (VIII).

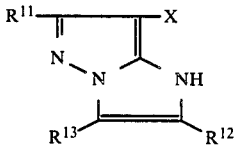

(II)

-continued

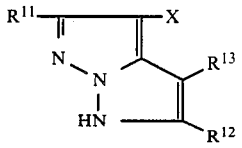

(III)

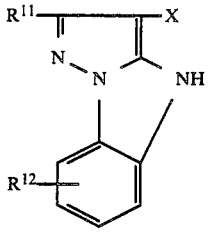

(IV)

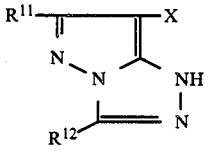

(V)

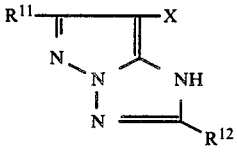

(VI)

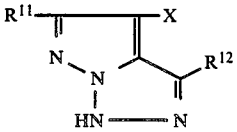

(VII)

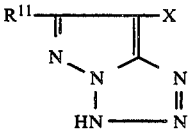

(VIII)

In general formulae (I) to (VIII), $R^{11}$, $R^{12}$ and $R^{13}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X represents a hydrogen atom, a halogen atom, a carboxyl group or a coupling-off group attached to the carbon atom in the coupling position through an oxygen atom, a nitrogen atom or a sulfur atom. Included are cases in which $R^{11}$, $R^{12}$, $R^{13}$ or X is a divalent group whereby a bis compound is formed.

These couplers of general formulae (II) to (VIII) may be polymeric couplers containing the coupler residue of general formulae (II) to (VIII) in the main chain or in the side chain thereof. In particular, polymers derived from vinyl monomers having the structure represented by these formulae are preferred. In the case of such polymeric couplers, $R^{11}$, $R^{12}$, $R^{13}$ or X represents a vinyl group or a linkage group.

In more detail, $R^{11}$, $R^{12}$ and $R^{13}$ each represents a hydrogen atom, a halogen atom (e.g., a chlorine atom, a bromine atom, etc.), an alkyl group (e.g., a methyl group, a propyl group, an isopropyl group, a t-butyl group, a trifluoromethyl group, a tridecyl group, a 2-{α-[3-(2-octyloxy-5-tert-octylbenzenesulfonamido)-phenoxy]tetradecanamido}ethyl group, a 3-(2,4-di-t-amylphenoxy)propyl group, an allyl group, a 2-dodecyloxyethyl group, a 1-(2-octyloxy-5-tert-octylbenzenesulfonamido)-2-propyl group, a 1-ethyl-1-[4-(2-butoxy-5-tert-octylbenzenesulfonamido)phenyl]methyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-amylphenoxy)-butyramido group, a γ-(3-t-butyl-4-hydroxyphenoxy)-butyramido group, an α-[4-(4-hydroxyphenylsulfonyl)-phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoyl group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecansulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[-3-(2,4-di-tert-amylphenoxy)propyl]-carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, a 3 -pentadecyloxycarbonyl group, etc.), or an aryloxycarbonyl group (e.g., a phenyloxycarbonyl group, etc.); and X represents a hydrogen atom, a halogen atom (e.g., a chlorine atom, a bromine atom, an iodine atom, etc.), a group bonded through a carboxy group or an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group bonded through a nitrogen atom (e.g., a benzenesulfonamido group, an N-ethyltoluenesulfonamido group, a heptafluorobutanamido group, a 2,3,4,5,6-pentafluorobenzamido group, an octansulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, etc.), an arylazo group (e.g., a 4-methoxyphenylazo group, a 4-pivaloylaminophenylazo group, a 2-naphthylazo group, a 3-methyl-4-hydroxyphenylazo group, etc.), a group bonded through a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

In the couplers represented by general formulae (II) and (III), $R^{12}$ and $R^{13}$ may combine to each other to form a 5- to 7-membered ring.

When $R^{11}$, $R^{12}$, $R^{13}$ or X is a divalent group to form a bis compound, $R^{11}$, $R^{12}$ and $R^{13}$ preferably each represents a substituted or unsubstituted alkylene group (e.g., a methylene group, an ethylene group, a 1,10-decylene group, —$CH_2CH_2$—O—$CH_2CH_2$—, etc.), a substituted or unsubstituted phenylene group (e.g., a 1,4-phenylene group, a 1,3-phenylene group,

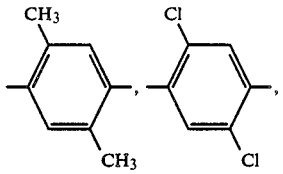

etc.), an —NHCO—$R^{14}$—CONH— group wherein $R^{14}$ represents a substituted or unsubstituted alkylene group or a substituted or unsubstituted phenylene group (e.g., —NHCO$CH_2CH_2$CONH—,

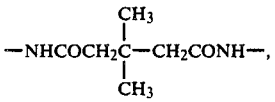

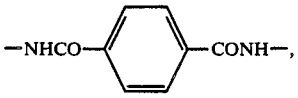

etc.), or an —S—$R^{15}$—S— group wherein $R^{15}$ represents a substituted or unsubstituted alkylene group (e.g., —S—$CH_2CH_2$—S—,

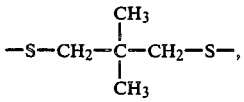

etc.); and X represents a group corresponding to the above mentioned groups in which pertinent positions are made divalent.

Where the basic structural elements of formulae (II), (III), (IV), (V), (VI), (VII) and (VIII) are contained in vinyl monomers, the linkage group represented by $R^{11}$, $R^{12}$, $R^{13}$ or X comprises a combination of groups selected from a substituted or unsubstituted alkylene group (e.g., a methylene group, an ethylene group, a 1,10-decylene group, —$CH_2CH_2OCH_2CH_2$—, etc.), a substituted or unsubstituted phenylene group (e.g., a 1,4-phenylene group, a 1,3-phenylene group,

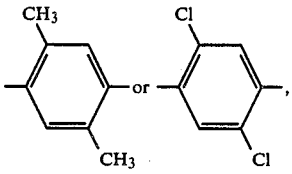

etc.), —NHCO—, —CONH—, —O—, —OCO— and an aralkylene group (e.g.,

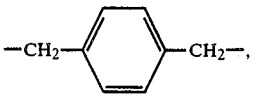

-continued

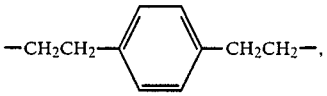

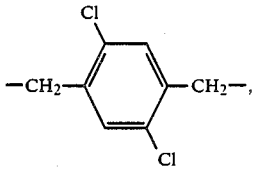

etc.).

Preferred linkage groups represented by $R^{11}$, $R^{12}$, $R^{13}$ or X are as follows:

—NHCO—,
—$CH_2CH_2$—,

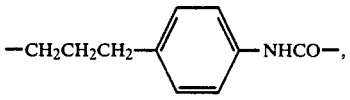

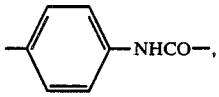

—$CH_2CH_2$NHCO—,

—$CH_2CH_2$—O—C(=O)—,

—CONH—$CH_2CH_2$NHCO—,
—$CH_2CH_2$O—$CH_2CH_2$—NHCO—, and

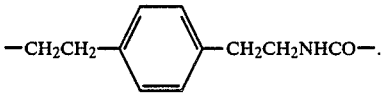

The vinyl group in the vinyl monomers may have any other substituents than the groups of formulae (I), (II), (III), (IV), (V), (VI), (VII) and (VIII); preferred substituents therefor are a chlorine atom or a lower alkyl group having 1 to 4 carbon atoms (e.g., a methyl group, an ethyl group, etc.).

The monomers containing the group represented by formulae (II), (III), (IV), (V), (VI), (VII) and (VIII) may form copolymers together with non-coloring ethylenic monomers which do not undergo a coupling reaction with an oxidation product of an aromatic primary amine developing agent.

The non-coloring ethylenic monomers which do not undergo a coupling reaction with an oxidation product of an aromatic primary amine developing agent include acrylic acid, α-chloroacrylic acid, α-alkylacrylic acids (e.g., methacrylic acid, etc.) and esters or amides derived from these acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxyethyl methacrylate, etc.), methylene dibisacrylamide, vinyl esters (e.g., vinyl acetate, vinyl propionate and vinyl laurate, etc.), acrylonitrile, methacrylonitrile, aromatic vinyl compounds (e.g,, styrene and derivatives thereof, vinyltoluene, divinylbenzene, vinylacetophenone and sulfostyrene etc.), itaconic acid, citraconic acid, crotonic acid, vinylidene chloride, vinylalkylethers (e.g., vinylethylether, etc.), maleic acid, maleic anhydride, maleates, N-vinyl-2-yrrolidone, N-vinylpyridine, and 2- and 4-vinylpyridines, etc.). These non-coloring ethylenic unsaturated monomers may be used in the present invention in the form of a mixture of two or more of them. For instance, combinations of n-butyl acrylate and methyl acrylate, styrene and methacrylic acid, methacrylic acid and acrylamide or methyl acrylate and diacetonacrylamide may be used.

As is well known in the field of polymeric color couplers, the non-coloring ethylenic unsaturated monomers to be copolymerized with solid water-insoluble monomer couplers can be selected so that the physical properties and/or chemical properties of the copolymers to be formed, such as solubility, compatibility with a binder of photographic colloid compositions (e.g., gelatin), flexibility and thermal stability, are influenced in a favorable manner by the selected monomers.

The polymeric couplers to be used in the present invention are preferably polymer coupler latexes.

Concrete examples of the pyrazoloazole type magenta couplers of formula (I) to be used in the present invention and the method for the synthesis of these couplers are described in Japanese Patent Application (OPI) Nos. 162548/84, 43659/85, 171956/84, 33552/85 and 172982/85 (the term "OPI" as used herein refers to a "published unexamined Japanese patent application"), and U.S. Pat. No. 3,061,432.

The use of high coloring ballast groups as described in Japanese Patent Applicaton (OPI) Nos. 402045/83, 214854/84, 177553/84, 177554/84 and 177557/84 as the above-described ballast group for the magenta couplers of the present invention can provide a higher color density and higher coloring speed.

Examples of the magenta couplers of the present invention will be shown hereinafter.

(M-1)

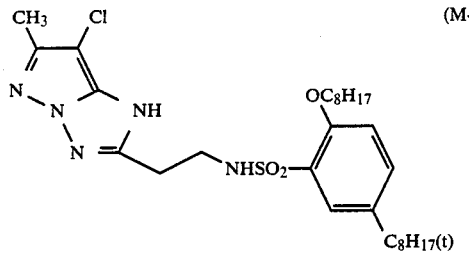

(M-2)

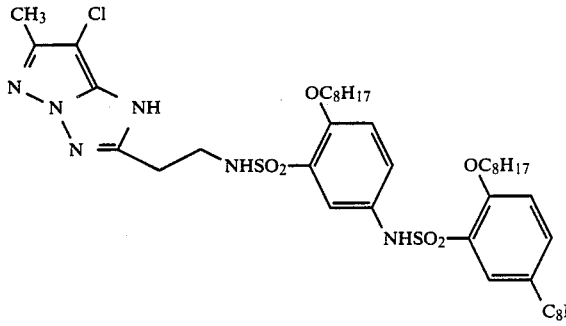

(M-3)

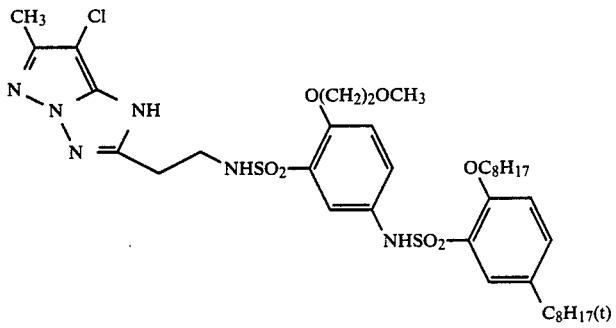

(M-4)

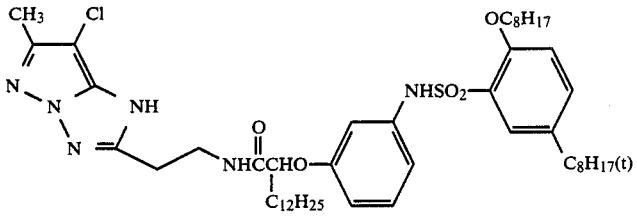

(M-5)

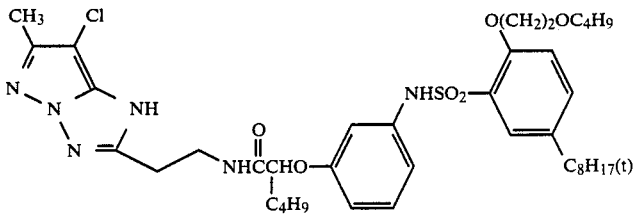

-continued
(M-6)
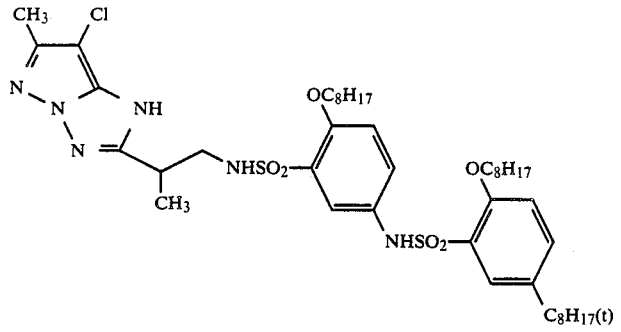
(M-7)
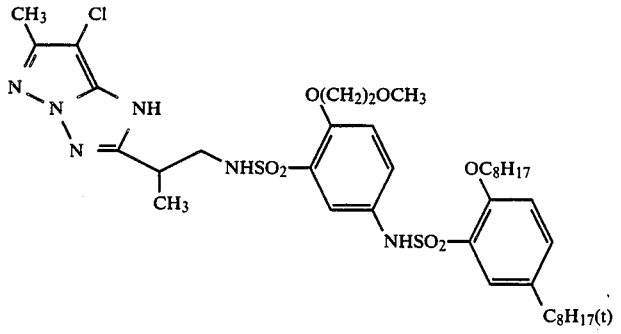
(M-8)
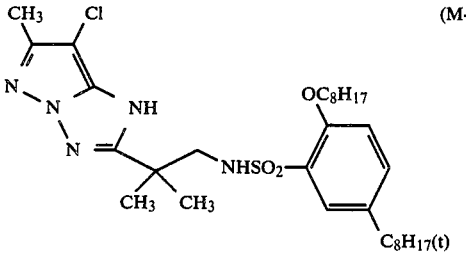
(M-9)
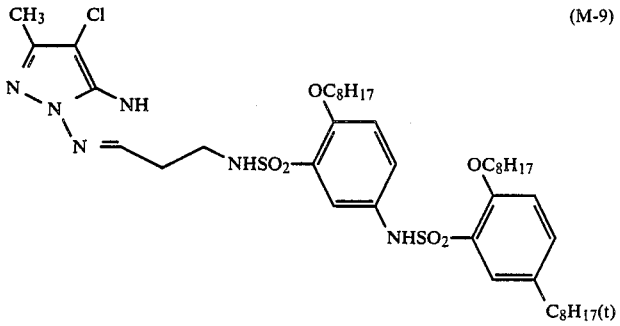
(M-10)
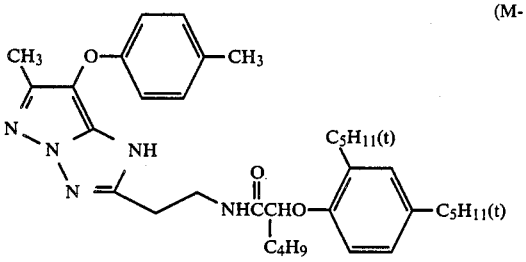
(M-11)
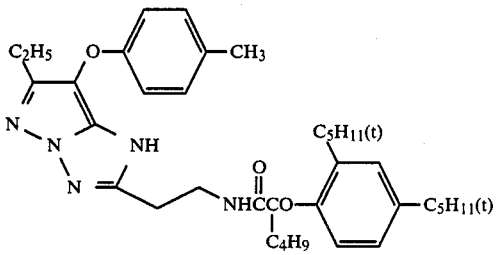
(M-12)
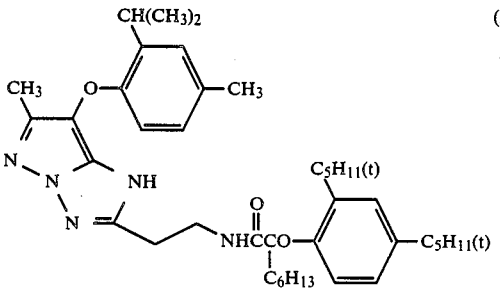
(M-13)
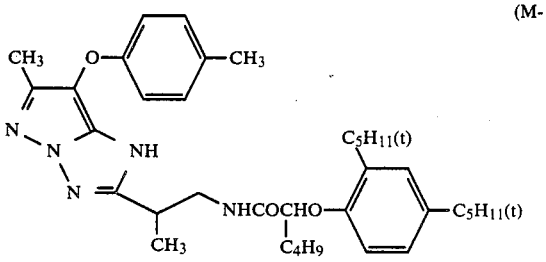

-continued
(M-14)
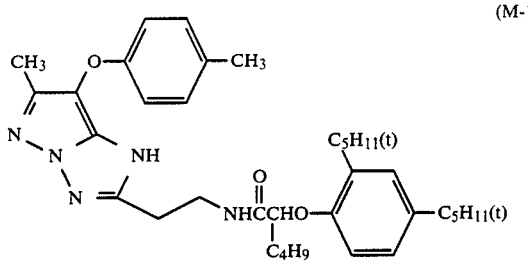
(M-15)
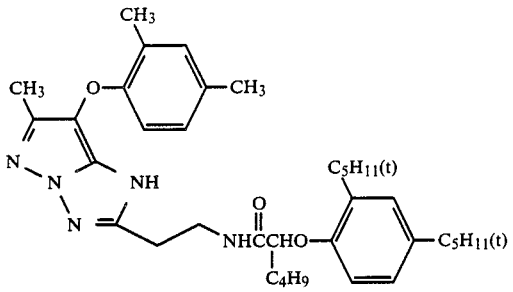
(M-16)
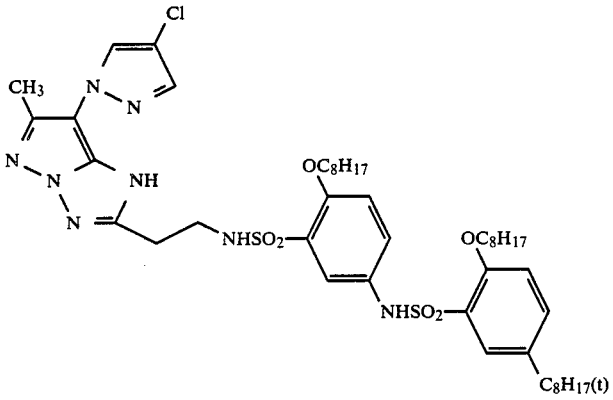
(M-17)
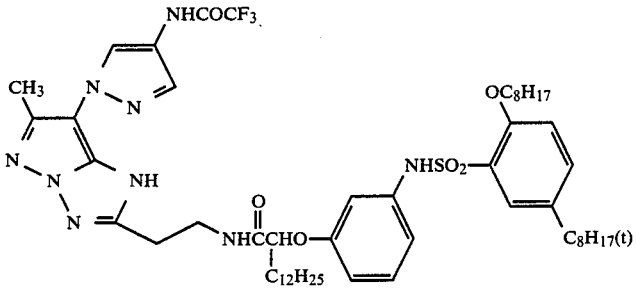
(M-18)
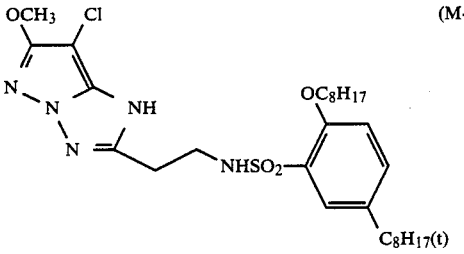
(M-19)
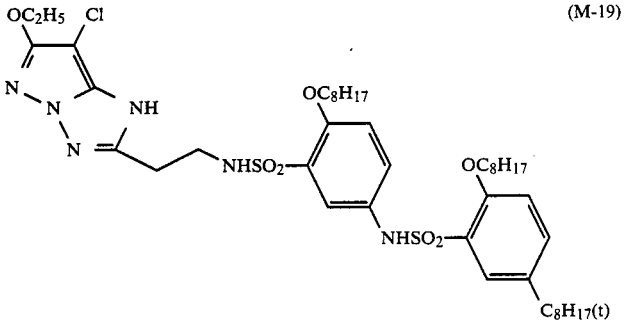
(M-20)
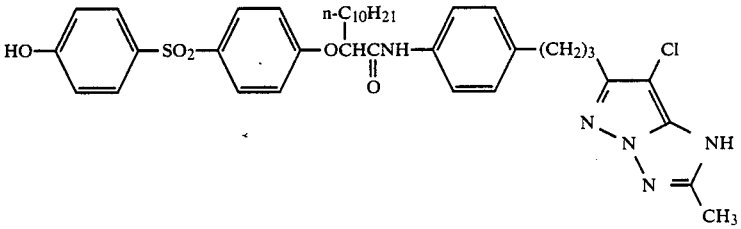

-continued
(M-21)
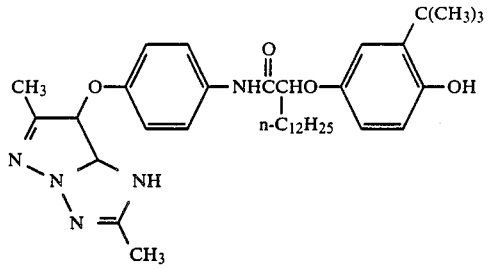
(M-22)
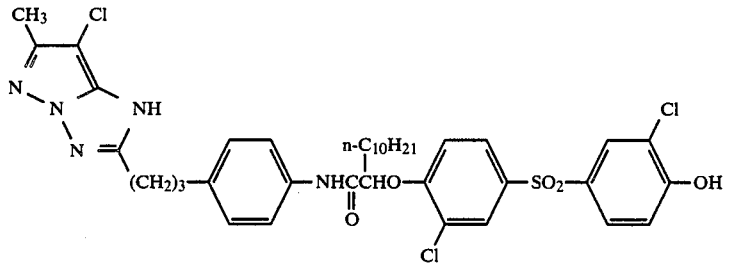
(M-23)
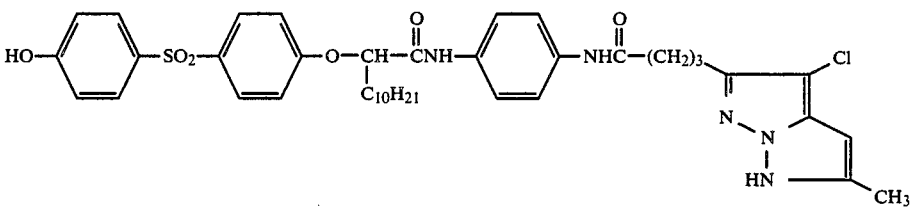
(M-24)
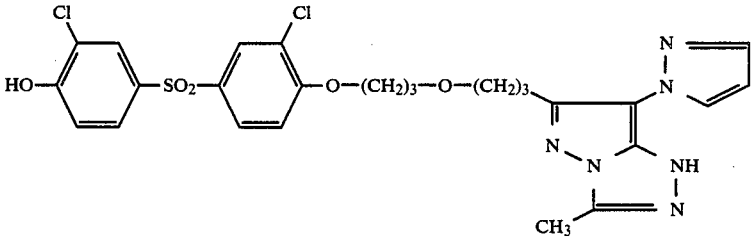
(M-25)
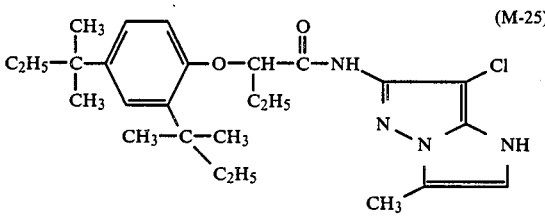
(M-26)
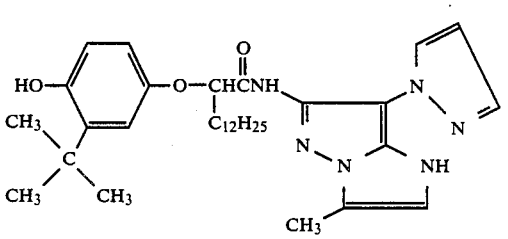
(M-27)
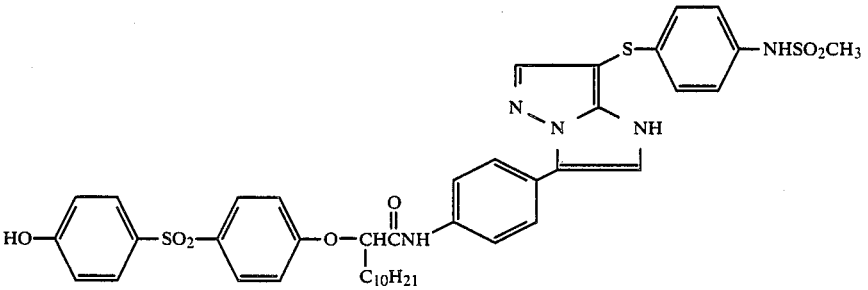

-continued (M-28)

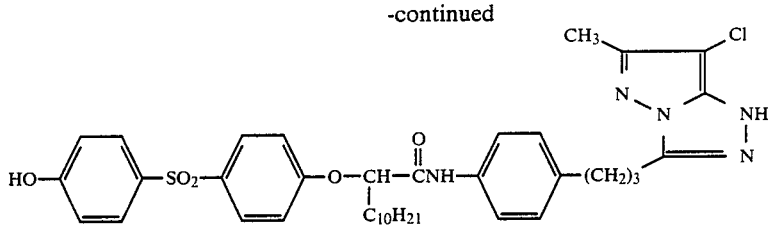

(M-29)

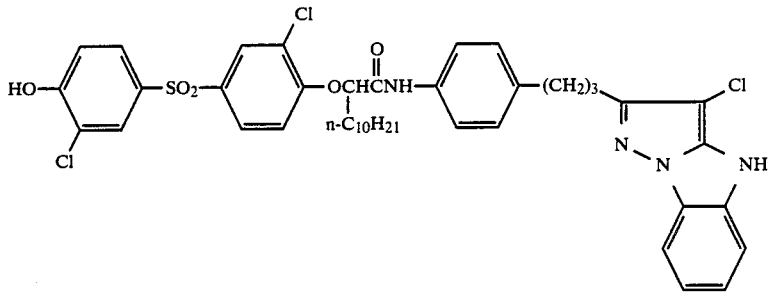

(M-30)

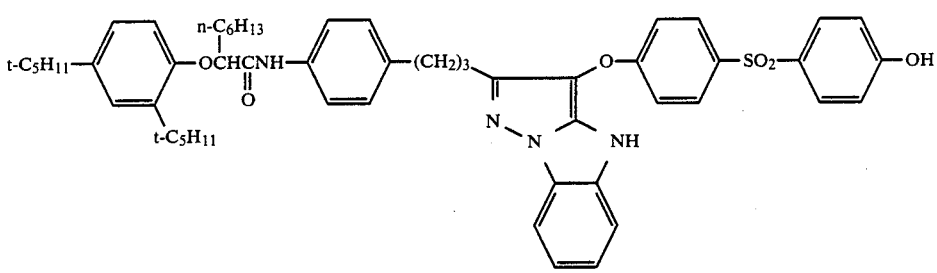

(M-31)

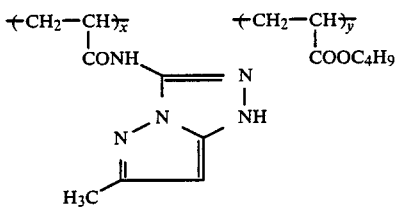

x/y = 50/50 (wt.)

(M-32)

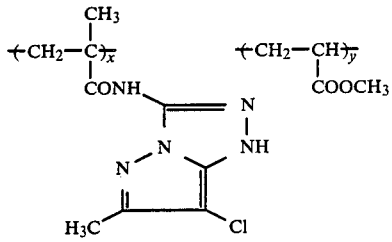

x/y = 40/60 (wt.)

(M-33)

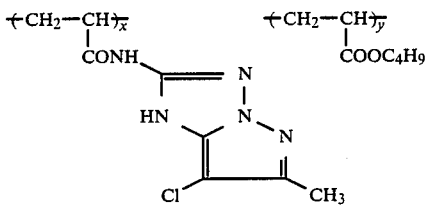

x/y = 50/50 (wt.)

(M-34)

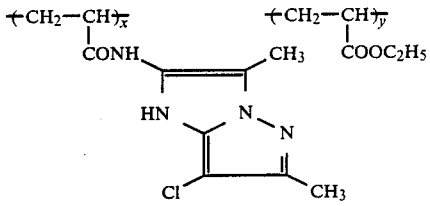

x/y = 55/45 (wt.)

Among the couplers of the above general formulae (II) or (VIII), those of formulae (II), (III), (IV), (V) and (VI) are preferred for obtaining the objects of the present invention, more preferred couplers are those of formulae (V) and (VI), and the most preferred couplers are those of formula (VI).

If a conventional 5-pyrazolone coupler is used as a magenta coupler, and the spectral sensitivity of the red-sensitive emulsion layer is shifted to the shorter wavelength region as in the present invention in order to improve the color reproducibility of a purple subject, the sensitivity of the red-sensitive emulsion layer to red light becomes short. This in turn makes the reproduction of red affected by a tincture of cyan and lowers the chroma.

The couplers of general formula (I) have less absorption of the cyan component in the longer wavelength region than conventional 5-pyrazolone couplers. Therefore, if the coupler of the present invention is used as a magenta coupler, and the spectral sensitivity of the red-sensitive emulsion layer is shifted to the shorter wavelength region as in the present invention in order to improve the purple reproducibility, the color reproducibility of red made mainly by the magenta dye and the yellow dye has less tincture of cyan, thus maintaining the chroma of red.

Thus, the color reproducibility of purple can be improved without lowering the chroma of red by using a coupler of general formula (I) as a magenta coupler and shifting the spectral sensitivity of the red-sensitive emulsion layer to the shorter wavelength region.

The coupler represented by general formula (I) and any suitable cyan and yellow couplers can be combined with silver halide emulsion layers having different color sensitivities. Preferably, a cyan coupler is added to the red-sensitive emulsion layer, a coupler of general formula (I), preferably a coupler represented by general formulae (II) to (VII), is added to the green-sensitive emulsion layer, and a yellow coupler is added to the blue-sensitive emulsion layer. Other combinations of color sensitivities of couplers and light-sensitive layers may also be used.

Two or more couplers selected from the group of couplers of the same hue as those represented by general formulae (II) to (VII) can be used in combination. These couplers may be emulsified together or separately. Further, these couplers may be used in combination with a deterioration inhibitor or oxidation inhibitor.

Examples of sensitizing dyes for the red-sensitive emulsion layer suitable for the objects of the present invention will be described hereinafter. However, the present invention should not be construed as being limited to these illustrative compounds. For example, any other sensitizing dye or combinations of two or more sensitizing dyes satisfying the spectral sensitivity range claimed by the present invention can be used in the present invention.

(S-1)

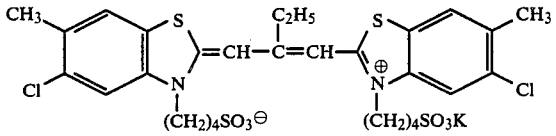

(S-2)

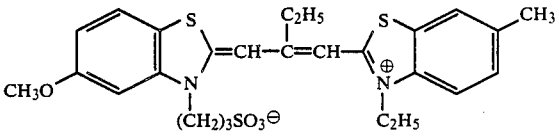

(S-3)

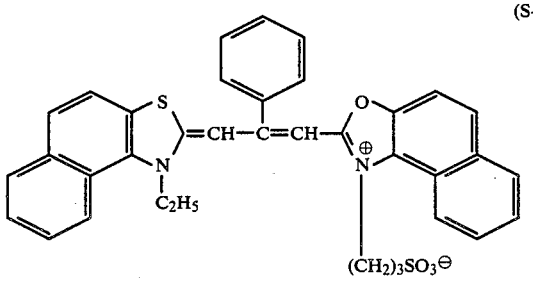

(S-4)

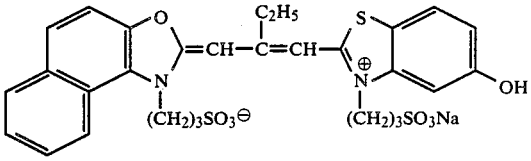

(S-5)

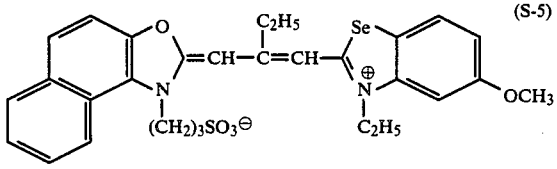

(S-6)

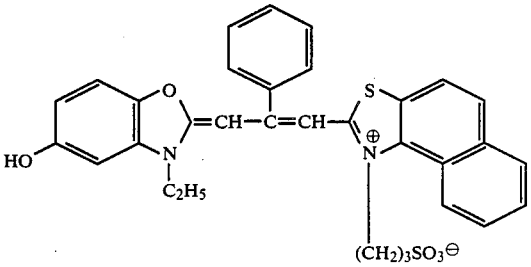

(S-7)

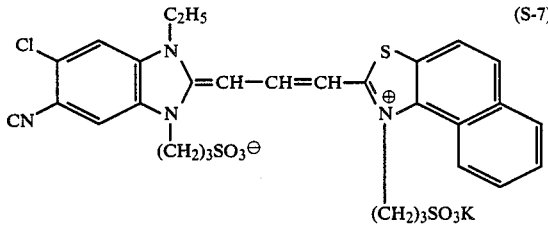

(S-8)

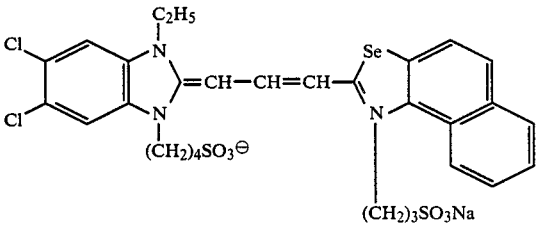

(S-9)

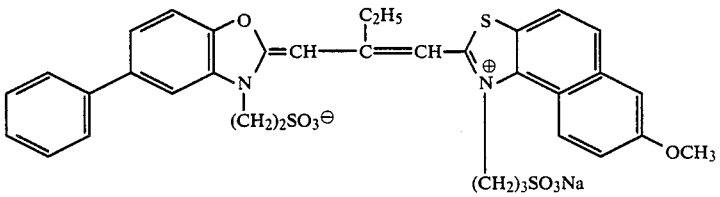

-continued (S-10)

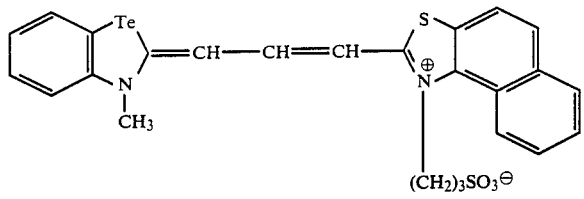

The relative spectral sensitivity in various wavelengths as referred to in the present invention is defined and expressed in accordance with the process described in T. H. James, *The Theory of the Photographic Process,* 4th Ed., page 510 (Macmillan Publishing Co., Inc., 1977).

The present invention can be applied to color reversal photographic materials to provide the most preferred effects. The development process for such a color reversal light-sensitive material is generally known to those skilled in the art. The typical color reversal process as used herein consists of the formation of a negative image by black-and-white development, exposure of the residual silver halide to light or treatment of the residual silver halide with a fogging agent, followed by formation of an immobile image dye in the development region by an aromatic primary amine color developing agent, and bleaching and fixation (optionally conducted simultaneously) for removal of the developed silver. This color reversal process also applies to a light-sensitive material using a negative type silver halide emulsion.

The photographic emulsion layer for the photographic light-sensitive material to be used in the present invention may comprise any of the silver halides selected from silver bromide, silver iodobromide, silver iodochlorobromide, silver chlorobromide, and silver chloride. A preferred silver halide composition is silver iodobromide or silver iodochlorobromide containing about 30 mol% or less silver iodide. A particularly preferred silver halide composition is silver iodobromide containing a 0.5 mol% to 10 mol% of silver iodide.

Silver halide grains may be any of so-called regular grains having cubic, octahedral, tetradecahedral or the like regular crystalline forms; grains having spherical or other irregular crystalline forms; grains having twin planes or other crystal defects; or grains comprising the composite forms of these crystalline forms.

Silver halide grains may be fine grains having a grain diameter of about 0.1 μm or less or may be large grains having a large grain size of up to about 10 μm (diameter of projected area); and these may form a monodispersed system emulsion having a narrow grain size distribution or a polydispersed system emulsion having a broad grain size distribution.

The silver halide photographic emulsions which may be used jointly in the present invenion may be prepared in a conventional manner. For instance, the methods described in *Research Disclosure,* Vol 176, No. 17643 (December, 1978), pp. 22–23, "I. Emulsion Preparation and Types" and *Research Disclosure,* Vol. 187, No. 18716 (November, 1979), p. 648 may be adopted to the present invention.

Further, the photographic emulsions to be used jointly in the present invention may be obtained in a conventional manner, for example, as described in P. Glafkides, *Chimie et Physique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964). For instance, any of an acid method, a neutral method or an ammonia method may be adopted to the formation of the emulsions; and to the reaction of a soluble silver salt and a soluble halogen salt, a single jet method, a double jet method or a combination thereof may be adopted. In addition, a method for the formation of silver halide grains in the presence of excess silver ions (which is a so-called reverse jet method) may also be utilized. A so-called controlled double jet method where the pAg value in the liquid phase for the formation of silver halides is maintained at a constant level amy also be used, which is one embodiment of the double jet method. According to this method, an emulsion of silver halide grains having regular crystalline forms and having a nearly uniform grain size may be obtained.

Furthermore, physical ripening can be conducted in the presence of a known silver halide solvent such as ammonia, potassium thiocyanate and thioether and thione compound as described in U.S. Pat. No. 3,271,157, Japanese Patent Application (OPI) Nos. 12360/76, 82408/78, 144319/78, 100717/79, and 155828/79. This process, too, can provide a silver halide emulsion having a regular crystal form and nearly uniform grain sizes.

Emulsions of silver halides of regular grains to be used jointly in the present invention may be obtained by properly controlling the pAg value and the pH value during the formation of the grains. The detail is described, for example, in *Photographic Science and Engineering,* Vol. 6, pp. 159–165 (1962), *Journal of Photographic Science,* Vol. 12, pp. 242–251 (1964), and U.S. Pat. No. 3,655,394 and British Pat. No. 1,413,748.

Typical monodispersed emulsions are those comprising silver halide grains having a larger average grain diameter than about 0.1 μm, at least 95 wt% of the grains having a grain size which falls within the scope of the average grain diameter, ±40%. In particular, emulsions containing silver halide grains which have an average grain diameter of 0.25 to 2 μm, at least 95 wt% (or at least 95% of the total number of grains) having a grain size which falls within the scope of the average grain diameter ±20%, are preferably used in the present invention. The manufacture of these emulsions is described, for example, in U.S. Pat. Nos. 3,574,628 and 3,655,394 and British Pat. No. 1,413,748. In addition, monodispersed emulsions as described in Japanese Patent Application (OPI) Nos. 8600/73, 39027/76, 8309/76, 137133/78, 48521/79, 99419/79, 37635/83 and 49938/83 may further preferably be used in the present invention.

Tabular grains having an aspect ratio in excess of 5 can also be used in the practice of the present invention. These tabular grains can be easily prepared by the methods described by Gutoff, *Photographic Science and Engineering,* Vol. 14, pages 248 to 257 (1970), U.S. Pat. Nos. 4,434,226, 4,414,310, 4,433,048 and 4,439,520 and British Pat. No. 2,112,157, for instance. The use of tabular grains affords the advantages of increased covering power and an improved color sensitization efficiency by sensitizing dyes as described in detail in U.S. Pat. No. 4,434,226 referred to hereinbefore.

The crystal structure of the grains may be uniform throughout or may have a heterogeneous halogen composition as to the interior and exterior regions, or even a laminar structure. Such emulsion grains are disclosed in British Pat. No. 1,027,146, U.S. Pat. Nos. 3,505,068 and 4,444,877 and Japanese Patent Application (OPI) No. 14331/85, for instance. The grains may consist of dissimilar silver halides joined by epitaxial junction or fused to compounds other than silver halides, such as silver rhodanate, lead oxide and so on. Such emulsion grains are disclosed in U.S. Pat. Nos. 4,094,684, 4,142,900 and 4,459,353, British Pat. No. 2,033,792, U.S. Pat. Nos. 4,349,622, 4,395,478, 4,433,501, 4,463,087, 3,656,962 and 3,852,067 and Japanese Patent Application (OPI) No. 162540/84, for instance.

In the formation of silver halide grains or in the physical ripening step thereof, a cadmium salt, a zinc salt, a lead salt, a thallium salt, an iridium salt or a complex salt thereof, a rhodium salt or a complex salt thereof or an iron salt or a complex salt thereof may be incorporated in the reaction system.

The silver halide photographic emulsions of the present invention may be any of a surface latent image type emulsion which may form a latent image mainly on the surfaces of grains, an internal latent image type emulsions which may form a latent image mainly in the internal parts of the grains.

The removal of soluble silver salts from the emulsions before or after the physical ripening thereof may be carried out by noodle washing, flocculation, sedimentation or ultrafiltration.

Photographic emulsions to be used in the invention are usually subjected to chemical ripening and spectral sensitization after physical sensitization after physical ripening. Additives which can be used in these steps are described in *Research Disclosure,* Nos. 17643 and 18716 as tabulated below. Other photographic additives which can be used in the present invention are also shown in the following table as quoted from the same publications.

| Additives and References Thereto | | |
|---|---|---|
| Additive | RD 17643 | RD 18716 |
| Chemical sensitizer | Page 23 | Right column on page 648 |
| Sensitivity increasing agent | Pages 23 to 24 | Right column on page 648 |
| Spectral sensitizer and Supersensitizer | Pages 23 to 24 | Right column on page 648 to right column on page 649 |
| Brightening agent | Page 24 | |
| Antifoggant and Stabilizer | Pages 24 to 25 | Right column on page 649 |
| Right absorbent, Filter dye, and Ultraviolet absorbent | Pages 25 to 26 | Right column on page 649 to left column on page 650 |
| Stain inhibitor | Right column on page 25 | Left column to right column on page 650 |
| Dye image stabilizer | Page 25 | |

-continued

| Additives and References Thereto | | |
|---|---|---|
| Additive | RD 17643 | RD 18716 |
| Hardener | Page 26 | Left column on page 651 |
| Binder | Page 26 | Left column on page 651 |
| Plasticizer and Lubricant | Page 27 | Right column on page 650 |
| Coating aid and Surface active agent | Pages 26 to 27 | Right column on page 650 |
| Antistatic agent | Page 27 | Right column on page 650 |

Various color couplers can be used in the present invention. Specific examples of applicable color couplers are described in patents cited in *Research Disclosure,* No. 17643, VII-C to G. Specific examples of anti-diffusible and hydrophobic 4- or 2-equivalent couplers which can preferably be used in the invention include those described in patents cited in *Research Disclosure,* No. 17643, VII-C and D, in addition, the following couplers.

Yellow couplers which can be used in the invention typically include acylacetamide couplers which have a ballast group and are thereby hydrophobic. Specific examples of the acylacetamide couplers are described, e.g., in U.S. Pat. Nos. 2,407,210, 2,875,057 and 3,265,506, etc. 2-Equivalent yellow couplers are preferred in the invention. Typical examples of such couplers include oxygen-releasable type yellow couplers as described in U.S. Pat. Nos. 3,408,194, 3,447,928, 3,933,501 and 4,022,620, etc.; and nitrogen-releasable type yellow couplers as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OPI) Nos. 2,219,917, 2,261,361, 2,329,587 and 2,433,812, etc. α-Pivaloylacetanilide couplers are excellent in color fastness particularly to light. α-Benzoylacetanilide couplers are excellent in color density.

Magenta couplers which can be used in the invention include indazolone or cyanoacetyl couplers, and preferably 5-pyrazolone and pyrazoloazole couplers, which have a ballast group and are thereby hydrophobic. Of the 5-pyrazolone couplers, those wherein the 3-position thereof is substituted with an arylamino group or an acylamino group are preferred from the standpoint of hue and density of developed colors. Typical examples of such 5-pyrazolone couplers are given, e.g., in U.S. Pat. Nos. 2,311,082, 2,343,703, 2,600,788, 2,908,573, 3,062,653, 3,152,896 and 3,936,015, etc. Coupling-off groups for 2-equivalent 5-pyrazolone couplers preferably include a coupling-off group containing a nitrogen atom as a coupling-off atom as disclosed in U.S. Pat. No. 4,310,619 and arylthio groups as disclosed in U.S. Pat. No. 4,351,897.

Cyan couplers which can be used in the present invention include hydrophobic and anti-diffusible naphthol or phenol couplers. Typical examples thereof are the naphthol couplers described in U.S. Pat. No. 2,474,293, and preferably 2-equivalent naphthol couplers having a coupling-off group containing an oxygen atom as a coupling-off atom as disclosed in U.S. Pat. Nos. 4,052,212, 4,146,396, 4,228,233 and 4,296,200. Specific examples of the phenol couplers are given, e.g., in U.S. Pat. Nos. 2,369,929, 2,801,171, 2,772,162 and 2,895,826.

Cyan couplers that are fast to moisture and heat are preferably used in the invention. Typical examples of such cyan couplers include phenol cyan couplers having an ethyl group or higher alkyl group at the meta-position of their phenol nucleus as described in U.S. Pat. No. 3,772,002; 2,5-diacylamino-substituted phenol couplers as described in U.S. Pat. Nos. 2,772,162, 3,758,308, 4,126,396, 4,334,011 and 4,327,173, West German Patent Application (OLS) No. 3,329,729, European Pat. No. 121,365, etc.; phenol couplers having a phenylureido group at the 2-position and an acylamino group at the 5-position as described in U.S. Pat. Nos. 3,446,622, 4,333,999, 4,451,559 and 4,427,767, etc.; and the like.

In order to compensate for any unnecessary absorption of the color dyes formed, color negative films for camera use preferably contain a colored coupler for masking. Typical examples of the colored couplers are yellow colored magenta couplers as described in U.S. Pat. No. 4,163,670 and Japanese Patent Publication No. 39413/82; and magenta colored cyan couplers as described in U.S. Pat. Nos. 4,004,929 and 4,138,258 and British Pat. No. 1,146,368. Other colored couplers are described in the aforesaid *Research Disclosure,* No. 17643, VII-G.

Graininess can be improved by a combined use of couplers which form dyes having moderate diffusibility. Specific examples of such couplers are described in U.S. Pat. No. 4,336,237 and British Pat. No. 2,152,570 as for magenta couplers; European Pat. No. 96,570 and West German Patent Application (OLS) No. 3,234,533 as for yellow, magenta and cyan couplers.

The dye-forming couplers and the abovementioned special couplers may be in the form of dimers or higher polymers. Typical examples of polymerized dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

Couplers capable of releasing a photographically useful residue upon coupling are also used in the invention to advantage. Useful DIR couplers capable of releasing a developing inhibitor are described in *Research Disclosure,* No. 17643, VII-F.

DIR couplers which may preferably be used in the present invention are developer-deactivating type couplers as typically described in Japanese Patent Application (OPI) No. 151944/82; timing type couplers as typically described in U.S. Pat. No. 4,248,962 and Japanese Patent Application (OPI) No. 154234/82; and reactive type couplers as typically described in Japanese Patent Application (OPI) No. 184248/85. In particular, especially preferred couplers are developer-deactivating type DIR couplers as described in Japanese Patent Application (OPI) Nos. 151944/82, 217932/83, 218644/85, 225156/85 and 233650/85; and reactive type DIR couplers as described in Japanese Patent Application (OPI) No. 184248/85.

The couplers may be incorporated into the photographic materials of the present invention by means of various known dispersion methods, and, for instance, typical methods are a solid dispersion method, an alkali dispersion method, preferably a latex dispersion method, more preferably an oil-in-water dispersion method. According to the oil-in-water dispersion method, a coupler is first dissolved in either a high boiling point organic solvent having a boiling point of 175° or higher or a so-called auxiliary solvent having a low boiling point or in a mixture of these two solvents, and then the resulting solution is finely dispersed in water or in an aqueous medium such as a gelatin aqueous solution in the presence of a surfactant. Examples of the high boiling point organic solvents are described, for example, in U.S. Pat. No. 2,322,027. The dispersion may be accompanied by phase inversion. If necessary, the auxiliary solvent as used in the dispersion may be removed or reduced by distillation, noodle washing or ultrafiltration, and then the coupler-containing dispersion is coated on a support.

The process and the effect of the latex dispersion method and specific examples of latexes to be used for the immersion in the method are described, for example, in U.S. Pat. No. 4,199,363 and German Patent Application (OLS) Nos. 2,541,274 and 2,541,230.

The present invention can be applied to a wide variety of color light-sensitive materials, typically including color negative films for general use or for cinematography, color reversal films for slides or TV, color paper, color positive film, color reversal paper, and the like. The present invention is preferably applied to color reversal film for camera use.

The present invention will be further illustrated in the following example, but the present invention should not be construed as being limited thereto. Unless otherwise indicated, all parts, percents, ratios and the like are by weight.

EXAMPLE

On a cellulose triacetate film support having a subbing layer, there was formed a multilayer color light-sensitive material as Sample 101 consisting of layers of the following compositions. The chemical structures of the various compounds abbreviated herein are shown following the description of the layer components.

First Layer: Antihalation Layer

A gelatin layer (thickness of dried film: 2 μm) containing the following components:

Black coloidal silver: 0.25 g/m$^2$
Ultraviolet Absorbent U-1: 0.04 g/m$^2$
Ultraviolet Absorbent U-2: 0.1 g/m$^2$
Ultraviolet Absorbent U-3: 0.1 g/m$^2$
High Boiling Point Organic Solvent O-1: 0.1 cc/m$^2$ Second Layer: Intermediate Layer A gelatin layer (thickness of dried film: 1 μm) containing the following components:

Compound H-1: 0.05 g/m$^2$
High Boiling Point Organic Solvent O-2: 0.05 cc/m$^2$ Third Layer: First Red-Sensitive Emulsion Layer A gelatin layer (thickness of dried film: 1 μm) containing the following components:

Silver iodobromide emulsion spectrally sensitized by Sensitizing Dyes S-1 and S-2 (iodine content: 4 mol%, average particle size: 0.3 μm): 0.5 g (silver)/m$^2$
Coupler C-1: 0.2 g/m$^2$
Coupler C-2: 0.05 g/m$^2$
High Boiling Point Organic Solvent O-2: 0.12 cc/m$^2$ Fourth Layer: Second Red-Sensitive Emulsion Layer A gelatin layer (thickness of dried film: 2.5 μm) containing the following components:

Silver iodobromide emulsion spectrally sensitized by Sensitizing Dyes S-1 and S-2 (iodine content: 2.5 mol%, average particle size: 0.55 μm): 0.8 g (silver)/m$^2$
Coupler C-1: 0.55 g/m$^2$ Coupler C-2: 0.14 g/m$^2$
High Boiling Point Organic Solvent O-2: 0.33 cc/m$^2$
Fifth Layer: Intermediate Layer A gelatin layer (thickness of dried film: 1 μm) containing the following components:
Compound H-1: 0.1 g/m$^2$
High Boiling Point Organic Solvent O-2: 0.1 cc/m$^2$
Sixth Layer: First Green-Sensitive Emulsion Layer A gelatin layer (thickness of dried film: 1 μm) containing the following components:
Silver iodobromide emulsion spectrally sensitized by Sensitizing Dyes S-3 and S-4 (iodine content: 3 mol%, average particle size: 0.3 μm): 0.7 g (silver)/m$^2$
Coupler C-3: 0.35 g/m$^2$
High Boiling Point Organic Solvent O-2: 0.26 cc/m$^2$
Seventh Layer: Second Green-Sensitive Emulsion Layer A gelatin layer (thickness of dried film: 2.5 μm) containing the following components:
Silver iodobromide emulsion spectrally sensitized by Sensitizing Dyes S-3 and S-4 (iodine content: 2.5 mol%, average particle size: 0.8 μm): 0.7 g (silver)/m$^2$
Coupler C-4: 0.25 g/m$^2$
High Boiling Point Organic Solvent O-2: 0.05 cc/m$^2$
Eighth Layer: Intermediate Layer A gelatin layer (thickness of dried film: 1 μm) containing the following components:
Compound H-1: 0.05 g/m$^2$
High Boiling Point Organic Solvent O-2: 0.1 cc/m$^2$
Ninth Layer: Yellow Filter Layer A gelatin layer (thickness of dried film: 1 μm) containing the following components:
Yellow colloidal silver: 0.1 g/m$^2$
Compound H-1: 0.02 g/m$^2$
Compound H-2: 0.03 g/m$^2$
High Boiling Point Organic Solvent O-2: 0.04 cc/m$^2$
Tenth Layer: First Blue-Sensitive Emulsion Layer A gelatin layer (thickness of dried film: 1.5 μm) containing the following components:
Silver iodobromide emulsion spectrally sensitized by Sensitizing dye S-5 (iodine content: 2.5 mol%, average particle size: 0.7 μm): 0.6 g (silver)/m$^2$
Coupler C-5: 0.5 g/m$^2$
High Boiling Point Organic Solvent O-2: 0.1 cc/m$^2$
Eleventh Layer: Second Blue-Sensitive Emulsion Layer A gelatin layer (thickness of dried film: 3 μm) containing the following components:
Silver iodobromide emulsion spectrally sensitized by Sensitizing Dye S-5 (iodine content: 2.5 mol%, average particle size: 1.2 μm): 1.1 g (silver)/m$^2$
Coupler C-5: 1.2 g/m$^2$
High Boiling Point Organic Solvent O-2: 0.23 cc/m$^2$
Twelfth Layer: First Protective Layer A gelatin layer (thickness of dried film: 2 μm) containing the following components:
Ultraviolet Absorbent U-1: 0.02 g/m$^2$
Ultraviolet Absorbent U-2: 0.03 g/m$^2$
Ultraviolet Absorbent U-3: 0.03 g/m$^2$
Ultraviolet Absorbent U-4: 0.29 g/m$^2$
High Boiling Point Organic Solvent O-1: 0.28 cc/m$^2$
Thirteenth Layer: Second Protective Layer A gelatin layer (thickness of dried film: 0.8 μm) containing the following components:
Emulsion of surface fogged finely divided particles of silver iodobromide (iodine content: 1 mol%, average particle size: 0.06 μm): 0.1 g (silver)/m$^2$
Polymethyl methacrylate grains (average particle diameter: 1.5 μm): 0.05 g/m$^2$ Besides the above compositions, Gelatin Hardener H-3 and a surfactant were added to the above layers.

The compounds which were used to prepare the above are shown below:

Coupler C-1

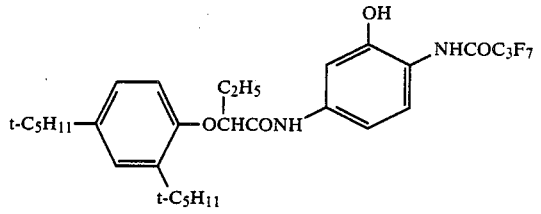

Coupler C-2

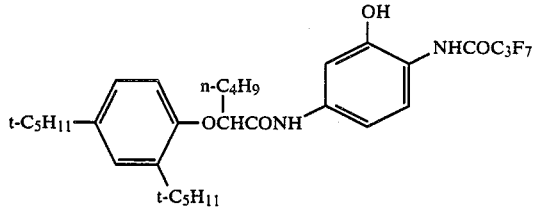

Coupler C-3

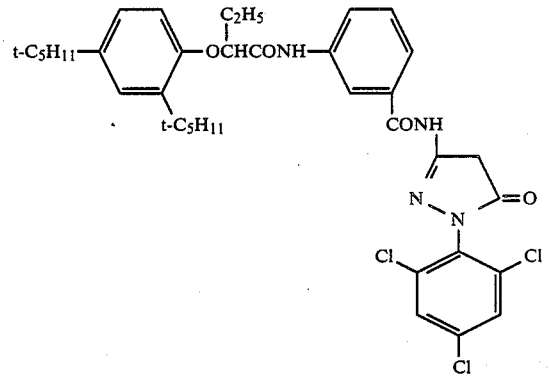

Coupler C-4

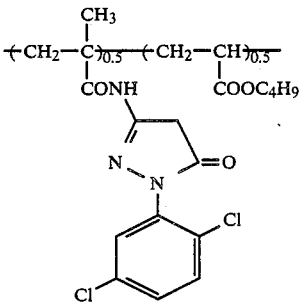

-continued

Coupler C-5

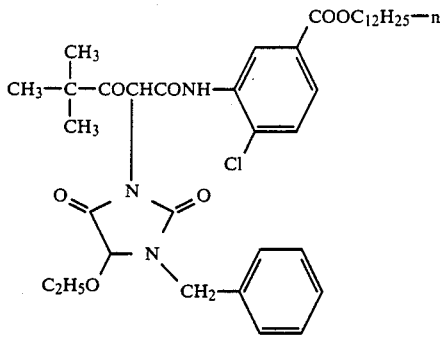

Ultraviolet Absorbent U-1

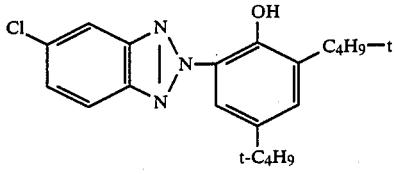

Ultraviolet Absorbent U-2

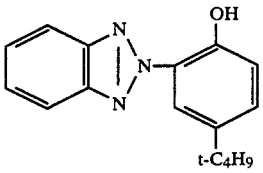

Ultraviolet Absorbent U-3

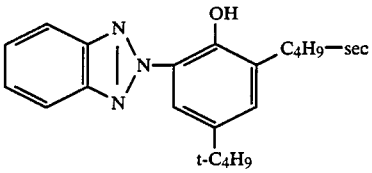

Ultraviolet Absorbent U-4

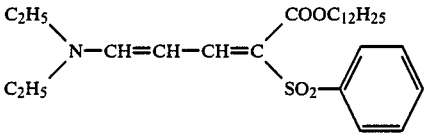

Compound H-1

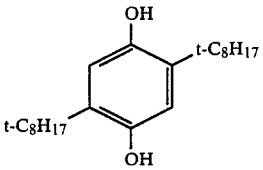

Compound H-2

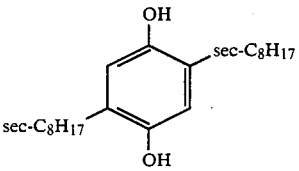

-continued

Gelatin Hardener H-3

$CH_2{=}CHSO_2CH_2CONHCH_2$
$CH_2{=}CHSO_2CH_2CONHCH_2$

High Boiling Point Organic Solvent O-1

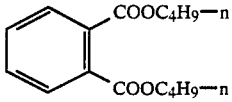

High Boiling Point Organic Solvent O-2

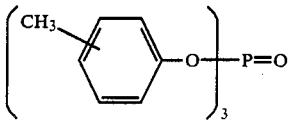

Sensitizing Dye S-1

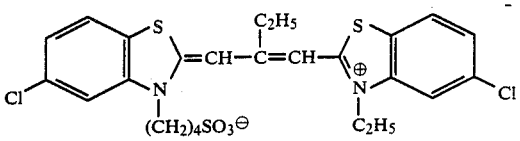

Sensitizing Dye S-2

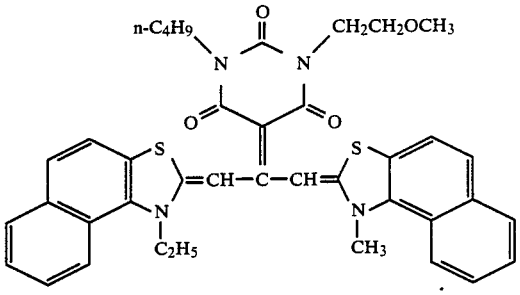

Sensitizing Dye S-3

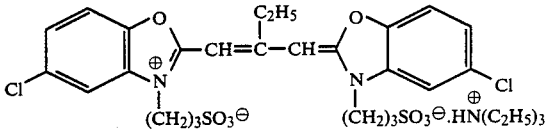

Sensitizing Dye S-4

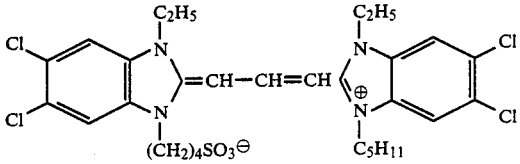

Sensitizing Dye S-5

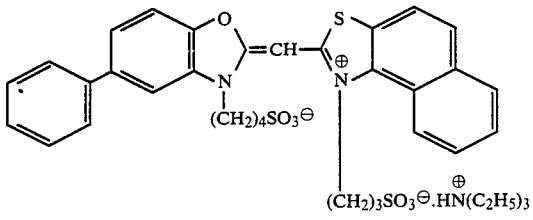

Sample 102 was prepared in the same manner as described above for Sample 101 except that the couplers for sixth and seventh layers were replaced by Coupler (M-6) as described in the specification above.

Sample 103 was prepared in the same manner as described above for Sample 101 except that the sensitizing dyes for the third and fourth layers were replaced by Sensitizing Dye S-3 as shown in the specification above. Further, Sample 104 was prepared in the same manner as described for Sample 103 except that the couplers for the sixth and seventh layers were replaced by Coupler (M-6) shown above.

These Samples 101 to 104 were subjected to photographing of a subject having red-based colors and purple-based colors. These samples were then subjected to the following color development treatments:

Treatment Steps

| Step | Time (min) | Temperature |
|---|---|---|
| First Development | 6 | 38° C. |
| Washing | 2 | " |
| Reversal | 2 | " |
| Color Development | 6 | " |
| Compensation | 2 | " |
| Bleaching | 6 | " |
| Fixation | 4 | " |
| Washing | 4 | " |
| Stabilization | 1 | Room Temperature |
| Drying | | |

Developer for the First Development

Water: 700 ml
Pentasodium Nitrilo-N,N,N-trimethylenephosphate: 2 g
Sodium Sulfite: 20 g
Hydroquinone Monosulfonate: 30 g
Sodium Carbonate (monohydrate): 30 g
1-Phenyl-4-methyl-4-hydroxymethyl-3-pyrazolidone: 2 g
Potassium Bromide: 2.5 g
Potassium Thiocyanate: 1.2 g
Potassium Iodide (0.1% solution): 2 ml
Water to make: 1,000 ml Reversal Processing Solution Water: 700 ml
Pentasodium Nitrilo-N,N,N-trimethylenephosphate: 3 g
Stannous Chloride (dihydrate): 1 g
p-Aminophenol: 0.1 g
Sodium Hydroxide: 8 g
Glacial Acetic Acid: 15 ml
Water to make: 1,000 ml Color Developer Water: 700 ml
Pentasodium Nitrilo-N,N,N-trimethylenephosphate: 3 g
Sodium Sulfite: 7 g
Sodium triphosphate (12 hydrate): 36 g
Potassium Bromide: 1 g
Potassium Iodide (0.1% solution): 90 ml
Sodium Hydroxide: 3 g
Citrazinic Acid: 1.5 g
N-Ethyl-N-(β-methanesulfonamidoethyl)-3-methyl-4-aminoaniline Sulfate: 11 g
3,6-Dithiaoctan-1,8-diol: 1 g
Water to make: 1,000 ml Compensating Solution Water: 700 ml
Sodium Sulfite: 12 g
Sodium Ethylenediaminetetraacetate (dihydrate): 8 g
Thioglycerin: 0.4 ml
Glacial Acetic Acid: 3 ml
Water to make: 1,000 ml Bleaching Solution Water: 800 ml
Sodium Ethylenediaminetetraacetate (dihydrate): 2 g
Ammonium Ethylenediaminetetraacetato Ferrate Dihydrate: 120 g
Potassium Bromide: 100 g
Water to make: 1,000 ml Fixing Solution Water: 800 ml
Sodium Thiosulfate: 80.0 g
Sodium Sulfite: 5.0 g
Sodium Bisulfite: 5.0 g
Water to make: 1,000 ml Stabilizing Solution Water: 800 ml
Formalin (37 wt%): 5.0 ml
Fuji Driwel (a surfactant made by Fuji Photo Film Co., Ltd.): 5.0 ml
Water to make: 1,000 ml These developed samples thus obtained were evaluated for color reproducibility. The results are shown in Table 1.

TABLE 1

| Film Tested | Purple Reproducibility | Red Chroma |
|---|---|---|
| Sample 101 (Comparison) | Poor | Excellent |
| Sample 102 (Comparison) | Poor | Excellent |
| Sample 103 (Comparison) | Excellent | Poor |
| Sample 104 (Invention) | Excellent | Excellent |

As shown in Table 1, the present invention can provide surprising improvement in purple reproducibility and red chroma over conventional color photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising at least one red-sensitive silver halide emulsion layer, at least one green-sensitive silver halide emulsion layer and at least one blue-sensitive silver halide emulsion layer on a support, wherein at least one coupler represented by general formula (I) is contained in at least said green-sensitive emulsion layer:

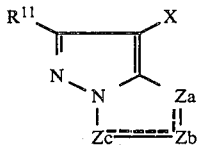

(I)

wherein $R^{11}$ represents a hydrogen atom or a substituent; X represents a hydrogen atom or a group releasable upon coupling with an oxidation product of an aromatic primary amine developing agent; Za, Zb and Zc each represents a methine group, a substituted methine group, =N— or —NH—; either one of the Za—Zb bond or the Zb—Zc bond is a double bond with the other being a single bond; when the Zb—Zc bond is a carbon-carbon double bond, it may form an aromatic ring; when any one of $R^{11}$, X and the substituted methine group as represented by Za, Zb or Zc is a divalent or polyvalent group, it may form a dimer or a polymer; and the wavelength at which said red-sensitive emulsion layer shows the maximum spectral sensitivity is in the range of about 620 to about 640 nm, in the short wavelength side of spectral sensitivity as to said red-sensitive emulsion layer, the wavelength corresponding to 80% of the maximum sensitivity is in the range of about 605 to about 630 nm, the wavelength corresponding to 50% of the maximum sensitivity is in the range of about 591 to about 622 nm, the wavelength corresponding to 40% of the maximum sensitivity is in the range of about 586 to about 618 nm, the wavelength corresponding to 20% of the maximum sensitivity is in the range of about 575 to about 600 nm, and the wavelength corresponding to 10% of the maximum sensitivity is in the range of about 567 to about 586 nm, and in the long wavelength side of spectral sensitivity as to said red-sensitive emulsion layer, the wavelength corresponding to 80% of the maximum sensitivity is in the range of about 631 to about 651 nm, the wavelength corresponding to 50% of the maximum sensitivity is in the range of abot 640 to about 658 nm, the wavelength corresponding to 40% of the maximum sensitivity is in the range of about 643 to about 660 nm, the wavelength corresponding to 20% of the maximum sensitivity is in the range of about 650 to about 666 nm and the wavelength corresponding to 10% of the maximum sensitivity is in the range of about 655 to about 670 nm.

2. A silver halide color photographic material as claimed in claim 1, wherein said coupler is represented by general formulae (II), (III), (IV), (V), (VI), (VII) and (VIII):

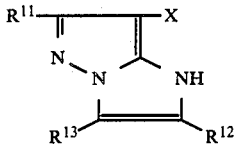
(II)

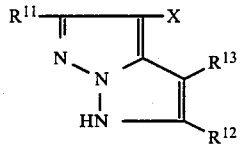
(III)

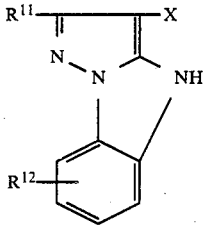
(IV)

-continued

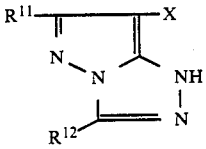
(V)

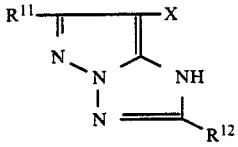
(VI)

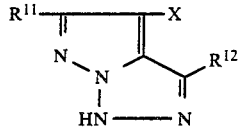
(VII)

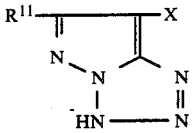
(VIII)

wherein $R^{11}$, $R^{12}$ and $R^{13}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents a hydrogen atom, a halogen atom, a carboxyl group or a coupling-off group attached to the carbon atom in the coupling position through an oxygen atom, a nitrogen atom or a sulfur atom; and $R^{11}$, $R^{12}$, $R^{13}$ or X may be a divalent group to form a bis compound.

3. A silver halide color photographic material as claimed in claim 2, wherein said coupler represented by general formulae (II), (III), (IV), (V), (VI), (VII) and (VIII) may be a polymeric couplers containing the coupler residue of general formulae (II) to (VIII) in the main chain or in the side chain thereof.

4. A silver halide color photographic material as claimed in claim 3, wherein said polymeric coupler is a polymer derived from vinyl monomers having the structure represented by general formulae (II) to (VIII) when $R^{11}$, $R^{12}$, $R^{13}$ or X represents a vinyl group or a linkage group.

5. A silver halide color photographic material as claimed in claim 2, wherein said $R^{12}$ and $R^{13}$ may combine to each other to form a 5- to 7-membered ring when said coupler is represented by general formulae (II) and (III).

6. A silver halide color photograhic material as claimed in claim 2, wherein when said $R^{11}$, $R^{12}$, $R^{13}$ or X is a divalent group to form a bis compound, $R^{11}$, $R^{12}$ and $R^{13}$ each represents a substituted or unsubstituted alkylene group, a substituted or unsubstituted phenylene group, an —NHCO—$R^{14}$—CONH— group wherein $R^{14}$ represents a substituted or unsubstituted phenylene group, an —S—$R^{15}$—S— group wherein $R^{15}$ represents a substituted or unsubstituted alkylene group; and X represents a group corresponding to the above mentioned group in which pertinent portions are made divalent.

7. A silver halide color photographic material as claimed in claim 4, wherein said linkage group represented by $R^{11}$, $R^{12}$, $R^{13}$ or X comprises a combination of groups selected from a substituted or unsubstituted alkylene group, a substituted or unsubstituted phenylene group, —NHCO—, —CONH—, —O—, —OCO— and an aralkylene group when the basic structural elements of general formulae (II), (III), (IV), (V), (VI), (VII) and (VIII) are contained in vinyl monomers.

8. A silver halide color photographic material as claimed in claim 7, wherein said vinyl group in said vinyl monomers has substituents in addition to the groups of general formulae (II), (III), (IV), (V), (VI), (VII) and (VIII), and said substituents are a chlorine atom or an alkyl group having 1 to 4 carbon atoms.

9. A silver halide color photographic material as claimed in claim 7, wherein said monomer containing the group represented by general formulae (II), (III), (IV), (V), (VI), (VII) and (VIII) may form a copolymer together with a non-coloring ethylenic monomers which do not undergo a coupling reaction with an oxidation product of an aromatic primary amine developing agent.

10. A silver halide color photographic material as claimed in claim 2, wherein said coupler is represented by general formulae (II), (III), (IV), (V) and (VI).

11. A silver halide color photographic material as claimed in claim 2, wherein said coupler is represented by general formulae (V) and (VI).

12. A silver halide color photographic material as claimed in claim 2, wherein said coupler is represented by general formula (VI).

13. A silver halide color photographic material as claimed in claim 1, wherein said silver halide color photographic material is applied to a color reversal photographic material.

* * * * *